United States Patent [19]

Rohrbach

[11] 4,375,194

[45] Mar. 1, 1983

[54] EXTENSIBLE DRIVE SHAFT

[75] Inventor: Peter H. Rohrbach, Nazareth, Pa.

[73] Assignee: S I Handling Systems, Inc., Easton, Pa.

[21] Appl. No.: 209,562

[22] Filed: Nov. 24, 1980

[51] Int. Cl.[3] ..... B61B 13/12

[52] U.S. Cl. ..... 104/166; 192/65; 192/66; 192/85 C; 403/13; 464/42; 464/43; 464/162; 464/183

[58] Field of Search ..... 104/165, 166; 64/1 C, 64/23, 23.5, 30 R; 192/65, 66, 85 C; 403/13, 14; 464/42, 43, 162, 183

[56] References Cited

U.S. PATENT DOCUMENTS

| | | | |
|---|---|---|---|
| 2,349,624 | 5/1944 | Higgins | 192/66 |
| 2,744,597 | 5/1956 | Merritt | 192/65 X |
| 3,283,588 | 11/1966 | Merchant | 64/23 X |
| 3,492,835 | 2/1970 | Polizzotto | 64/30 R X |
| 4,125,000 | 11/1978 | Grob | 64/23 |
| 4,132,174 | 10/1976 | Ziegenfus | 104/48 |

FOREIGN PATENT DOCUMENTS

| | | | |
|---|---|---|---|
| 1230626 | 12/1966 | Fed. Rep. of Germany | 64/23 |

*Primary Examiner*—Randolph Reese

*Attorney, Agent, or Firm*—Seidel, Gonda, Goldhammer & Panitch

[57] ABSTRACT

The drive shaft assembly comprises first and second telescoping shafts supported above ground level. A motor is coupled to the first shaft for extending it in an axial direction. Another motor is connected to the second shaft for rotating the second shaft about its longitudinal axis. These shafts are connected by a coupling so that the second shaft rotates the first shaft in all positions of the first shaft. The first shaft terminates at a free end in a frictional engageable end portion.

12 Claims, 5 Drawing Figures

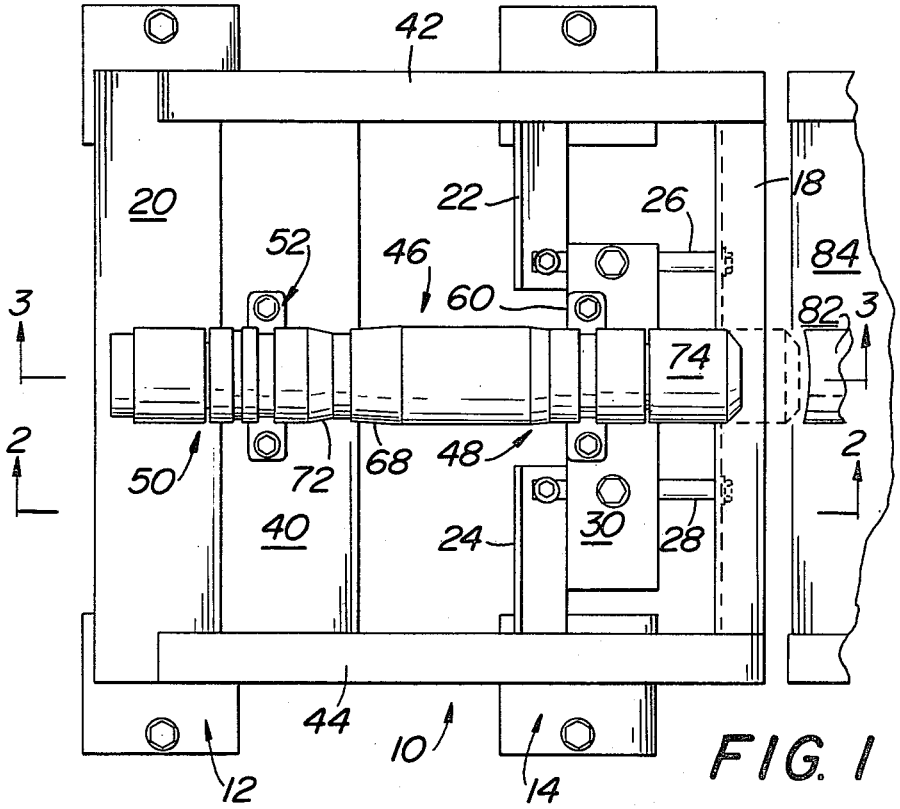
FIG. 1
FIG. 2
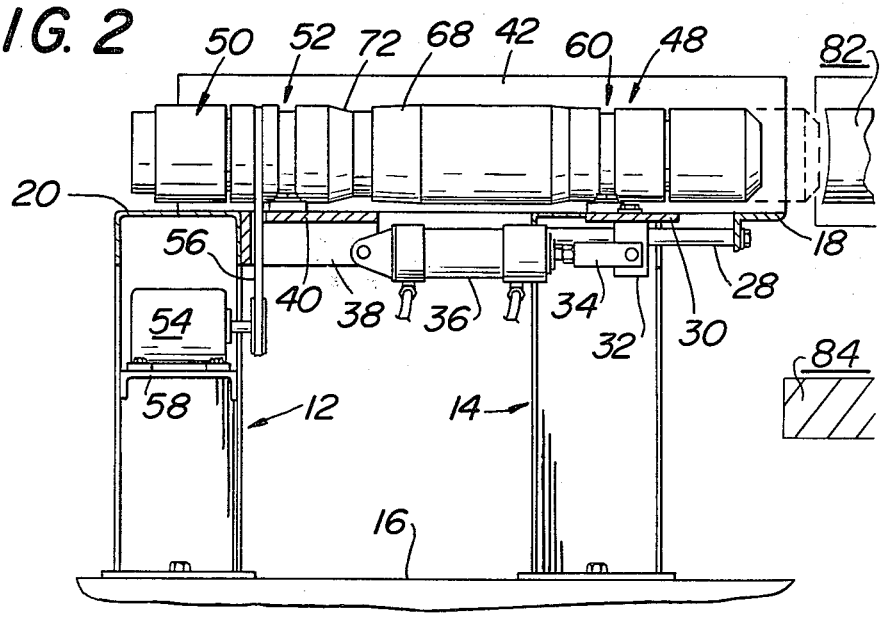

EXTENSIBLE DRIVE SHAFT

BACKGROUND

Driverless vehicle conveyor systems are known. See U.S. Pat. No. 4,132,174. In such systems, one drive shaft associated with stationary tracks is to be connected to another drive shaft on a turntable, shuttle vehicle, or the like to facilitate transfer of a driverless vehicle onto or off of the turntable or shuttle vehicle.

In that environment, the present invention seeks to improve the manner in which a drive shaft associated with stationary tracks is to be coupled to a drive shaft on a turntable or shuttle vehicle.

SUMMARY OF THE INVENTION

The present invention is directed to an extensible drive shaft assembly for use in a driveless vehicle conveyor system. In such a system, driverless vehicles ride on rails and have a drive wheel in contact with a drive shaft between the rails. The drive shaft assembly forming the subject matter of the present invention includes first and second telescoping drive shafts mounted on a support. A motor means is coupled to the first shaft for extending it in an axial direction. Another motor means is connected to the second shaft for rotating the second shaft about its longitudinal axis. A coupling means interconnects the shafts so that the second shaft rotates the first shaft in all positions of the first shaft. The first shaft is provided with a frictional engageable end portion at a free end thereof.

It is an object of the present invention to provide an extensible drive shaft assembly which provides for a direct coupling between the drive shaft assembly and a drive shaft on a turntable, shuttle vehicle, or the like.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a top plan view of a drive shaft assembly in accordance with the present invention.

FIG. 2 is a sectional view taken along the line 2—2 in FIG. 1.

DETAILED DESCRIPTION

Figure 3:
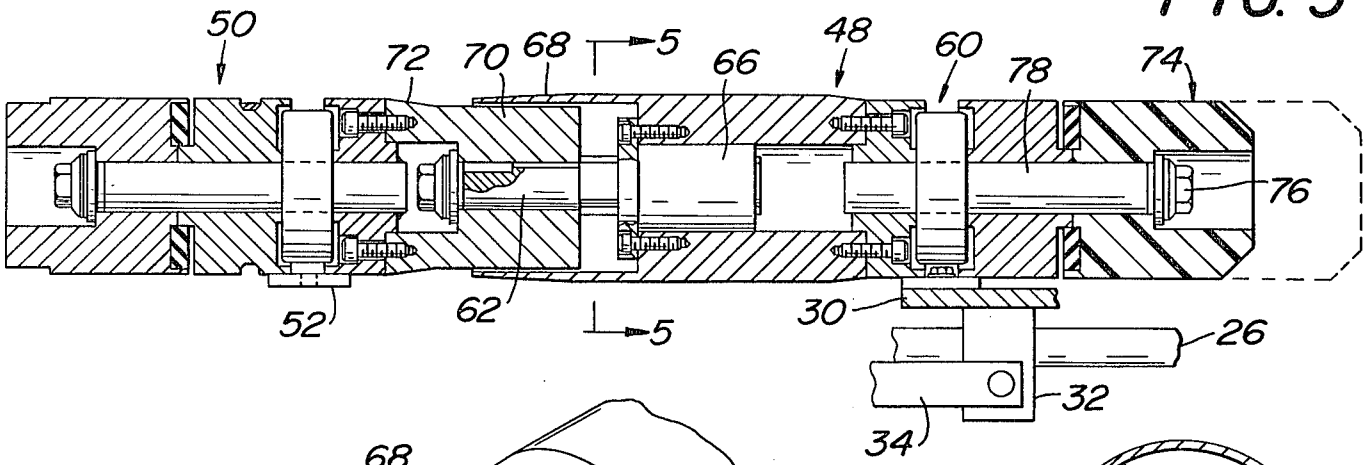
FIG. 3 is a longitudinal sectional view of the drive shaft taken along the line 3—3 in FIG. 1.

Referring to the drawings in detail, wherein like numerals indicate like elements, there is shown in FIG. 1 a drive shaft assembly in accordance with the present invention designated generally as 10. The drive shaft assembly 10 includes upright supports 12 and 14 having ground engaging plates bolted to the ground 16. The supports include horizontally disposed cross braces 18 and 20 which are at the same elevation.

Support 14 is provided with at least one and preferably two brackets designated 22 and 24 which are aligned with one another and at an elevation whereby they may support one end of the rods 26, 28. The other end of the rods are supported by the cross brace 18 which is preferably an angle iron as shown in FIG. 2. The rods 26, 28 are preferably non-circular in section, such as being rectangular. A base plate 30 is supported by and is slideable along the rods 26, 28 in a non-rotatable manner.

A bracket 32 depends from the lower surface of base plate 30 and is connected to a piston rod adaptor 34. Piston rod adaptor 34 is connected to a piston rod associated with the pneumatic cylinder 36. Adaptor 34 and bracket 32 support one end of the cylinder 36. The other end of the cylinder 36 is connected to a bracket 38 depending from the support plate 40. Support plate 40 is fixedly secured to the support 12 at the same elevation as the base plate 30.

Rails 42 and 44 extend longitudinally along the sides of the assembly 10 and interconnect the supports 12 and 14 as well as the cross brace 18 and the support plate 40. The upper surface of the rails 42, 44 is at an elevation which is above the elevation of the upper surface of a drive shaft 46. Drive shaft 46 is comprised of two shafts, namely a first shaft 48 and a second shaft 50.

The second shaft 50 is supported on the plate 40 by means of a bearing 52. A motor 54 has its output pulley connected to shaft 50 by way of an endless belt 56. Belt 56 extends in a groove on the outer periphery of drive shaft 50 for rotating drive shaft 50 about its longitudinal axis. Motor 54 is supported in any convenient manner such as by bracket 58 on the support 12.

Figure 5:
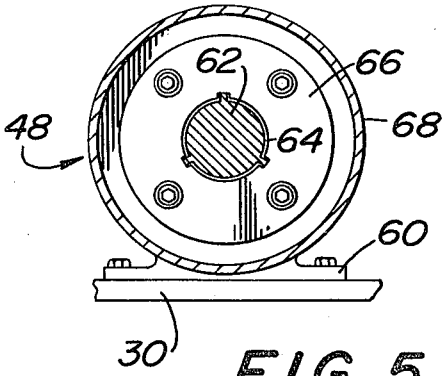
FIG. 5 is a sectional view taken along the line 5—5 in FIG. 3.
Figure 4:
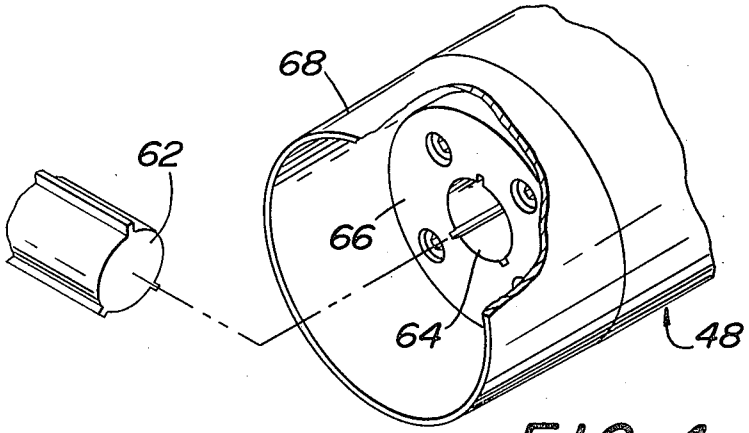
FIG. 4 is an exploded partial perspective view of a coupling between the drive shafts.

The first shaft 48 is supported by a bearing 60 mounted on the base plate 30. The first shaft 58 is extensible from the solid line position shown in FIGS. 1 and 2 to the phantom position shown therein. The shaft 48 is coupled to shaft 50 in a manner so that shafts 48, 50 rotate in all positions of shaft 48 such as by a splined shaft 62. See FIGS. 4 and 5.

The splined shaft 62 has one end fixedly secured to one of the shafts such as the shaft 50. The other end of splined shaft 62 extends through a mating hole 64 in a guide 66 on shaft 48. Guide 66 is bolted to one end of the shaft 48. Said one end of shaft 48 has an axially extending sleeve 68 telescoped over a reduced diameter portion 70 of the shaft 50. The reduced diameter portion 70 is connected to the outer diameter of shaft 50 by an inclined portion 72. The splined shaft 62 remains telescoped with respect to guide 66 in all positions of the shaft 48. Likewise, sleeve 68 remains telescoped over portion 70 in all positions of the shaft 48.

The terminal free end of the shaft 48 as shown more clearly in FIG. 3 terminates in a frictional engageable nose portion 74. Portion 74 has an axial hole for receiving one end of a rod 78 fixed to the shaft 48. Rod 78 is fixedly secured to the nose portion 74 by bolt or fastener means 76.

OPERATION

The assembly 10 is bolted to a floor at a location wherein it is desired to transfer a driverless vehicle onto drive shaft 46 or off drive shaft 46 by way of turntable, shuttle vehicle or the like, 84. Such turntable or shuttle vehicle will have a drive shaft 82 at the same elevation of drive shaft 46 and will be aligned therewith but is non-powered. When such turntable shuttle vehicle or the like 84 is in position so that its drive shaft 82 is aligned with and spaced from nose portion 74, a microswitch will be tripped so as to supply pressurized air to cylinder 36. The piston rod associated with cylinder 36 moves from left to right in FIG. 2 thereby shifting the base plate 30 from left to right in FIGS. 1 and 2. This action extends the nose portion 74 from the solid line position to the phantom position for contact with a mating surface on the drive shaft associated with the turntable or shuttle vehicle or the like.

Motor 54 drives the shaft 50. Shaft 50 drives shaft 48 which in turn drives the drive shaft frictionally engaged with the nose portion 74 which acts like a clutch. After a driverless vehicle has been transferred off shaft 46 or onto shaft 46, a microswitch will be tripped to reverse the supply of pressurized air to cylinder 36. As a result, the shaft 48 will be retracted to the solid line position as shown in FIGS. 1 and 2.

Various details of interconnection of sections of the drive shaft 46 illustrated in the drawing but not described above are exemplary and per se form no part of the present invention. The important aspects of the drive shaft 46 is the telescoping arrangement for maintaining substantial continuity of the outer peripheral surfaces of the shafts 48, 50 in all positions of shaft 48 relative to shaft 50 while both shafts 48, 50 are driven by motor 54. The use of a splined shaft 62 is exemplary and other constructions such as shafts which are triangular or rectangular in section may be utilized to accomplish the same result. While greater stability and reliability is attained by having each of the shafts 48, 50 with its own separate bearing, and is the preferred construction as illustrated, the extensible shaft 48 need not have a separate bearing. It will be appreciated that the assembly as illustrated is quite short whereas in actual practice the assembly will be made in modules of substantial length and interconnected together beginning with the left-hand end of the assembly as illustrated in the drawing.

The present invention may be embodied in other specific forms without departing from the spirit or essential attributes thereof and, accordingly, reference should be made to the appended claims, rather than to the foregoing specification, as indicating the scope of the invention.

I claim:

1. An extensible drive shaft assembly for use in connection with a driverless vehicle conveyor system wherein such vehicles ride on rails and have a drive wheel in contact with a drive shaft, the drive shaft assembly comprising a pair of rails, first and second telescoping drive shafts parallel to said rails, said first and second drive shafts being coaxially aligned and disposed end-to-end, motor means coupled to the first shaft for extending it in an axial direction, another motor means connected to the second shaft for rotating the second shaft about its longitudinal axis, means coupling said shafts so that said second shaft rotates said first shaft in all positions of the first shaft, and a frictional engageable end portion on a free end of said first shaft.

2. An assembly in accordance with claim 1 wherein said first-mentioned motor means is connected to a base plate, a bearing on said base plate and supporting said first shaft, and guide means for guiding said base plate for reciprocation in a direction parallel to the longitudinal axes of said first and second shafts.

3. An assembly in accordance with claim 1 wherein said first and second shafts are between and equidistant from said rails at an elevation below the elevation of the upper surface of said rails.

4. An assembly in accordance with claim 1 wherein said coupling means includes a rod along the axis of said first and second shafts.

5. An assembly in accordance with claim 1 including one of said shafts having a sleeve telescoped over the outer periphery of a reduced diameter portion on the other shaft with substantial continuity of their outer peripheral surfaces in all positions of said first shaft relative to said second shaft.

6. A drive shaft assembly comprising a first plate means supported for reciprocation, a second plate means which is stationary, said plate means being at approximately the same elevation, a first drive shaft supported by said first plate means and projecting therebeyond, a second drive shaft supported by said second plate means, said shafts being coaxial and telescoped so that the periphery of the first and second shafts have substantial continuity, a coupling means interconnecting said shafts for transmitting rotation from one shaft to the other, a first motor means connected to said second shaft for rotating said second shaft about its longitudinal axis, a second motor means connected to said first plate means for reciprocating said first plate means in a direction parallel to the axis of said shafts, and a friction transmitting member secured to a free end of said first shaft.

7. An assembly in accordance with claim 6 wherein said coupling means includes a rod along the axis of said shafts, one end of said rod being fixed to one of said shafts, the other end of said rod being telescoped into the other of said shafts.

8. An assembly in accordance with claim 6 including a stationary floor mounted support for said first and second plate means and for said shafts.

9. An assembly in accordance with claim 6 wherein each shaft is supported on its associated plate means by a discrete bearing.

10. An extensible drive shaft assembly for transferring driverless vehicles in a conveyor system between stationary and non-stationary track wherein said vehicles ride on rails and have a drive wheel in contact with a drive shaft, said drive shaft assembly associated with said stationary track, said drive shaft assembly comprising a pair of rails, first and second telescoping drive shafts parallel to said rails, motor means coupled to the first shaft for extending it in an axial direction, another motor means connected to the second shaft for rotating the second shaft about its longitudinal axis, means coupling said shafts so that said second shaft rotates said first shaft in all positions of the first shaft, and a frictional engageable end portion on a free end of said first shaft.

11. An assembly in accordance with claim 10 wherein said non-stationary track is on a turntable.

12. An assembly in accordance with claim 10 wherein said non-stationary track is on a shuttle vehicle.

* * * * *